US009688080B2

(12) United States Patent
Okawa

(10) Patent No.: US 9,688,080 B2
(45) Date of Patent: Jun. 27, 2017

(54) INKJET PRINTING APPARATUS AND INKJET PRINTING METHOD

(71) Applicant: MIMAKI ENGINEERING CO., LTD., Nagano (JP)

(72) Inventor: Masakatsu Okawa, Nagano (JP)

(73) Assignee: MIMAKI ENGINEERING CO., LTD., Nagano (JP)

( * ) Notice: Subject to any disclaimer, the term of this patent is extended or adjusted under 35 U.S.C. 154(b) by 0 days.

(21) Appl. No.: 15/125,183

(22) PCT Filed: Mar. 6, 2015

(86) PCT No.: PCT/JP2015/056617
§ 371 (c)(1),
(2) Date: Sep. 11, 2016

(87) PCT Pub. No.: WO2015/137243
PCT Pub. Date: Sep. 17, 2015

(65) Prior Publication Data

US 2017/0072706 A1 Mar. 16, 2017

(30) Foreign Application Priority Data

Mar. 12, 2014 (JP) ..... 2014-049389

(51) Int. Cl.
*B41J 2/15* (2006.01)
*B41J 11/00* (2006.01)
*B41J 2/01* (2006.01)

(52) U.S. Cl.
CPC ..... *B41J 11/002* (2013.01); *B41J 2/01* (2013.01)

(58) Field of Classification Search
CPC .... B41J 11/002; B41J 11/0015; B41J 3/4073; B41J 11/008; B41J 2/04501
See application file for complete search history.

(56) References Cited

U.S. PATENT DOCUMENTS 8,292,391 B2 * 10/2012 Ishimoto ..... B41J 2/2114 347/14
8,955,934 B2 * 2/2015 Ishimoto ..... B41J 2/2114 347/14

FOREIGN PATENT DOCUMENTS

| | | |
|---|---|---|
| JP | 2010-195002 | 9/2010 |
| JP | 2012-101367 | 5/2012 |
| JP | 2012-232529 | 11/2012 |

OTHER PUBLICATIONS

"International Search Report (Form PCT/ISA/210)", mailed on May 26, 2015, with English translation thereof, pp. 1-4.

* cited by examiner

*Primary Examiner* — Lamson Nguyen
(74) *Attorney, Agent, or Firm* — Jianq Chyun IP Office

(57) ABSTRACT

There is provided an inkjet printing apparatus and an inkjet printing method that may obtain a printed matter that excels in glossiness. An inkjet printing apparatus 1 has an irradiation controller 20. The irradiation controller 20 turns on ones of a plurality of irradiation elements corresponding to passes before and inclusive of a (n−m)th pass (m is an integer smaller than n and greater than or equal to 1), and turns off or controls ones of the plurality of irradiation elements corresponding to a last (m)th pass to have a lower illuminance than the irradiation elements corresponding to the passes before and inclusive of the (n−m)th pass.

19 Claims, 5 Drawing Sheets

INKJET PRINTING APPARATUS AND INKJET PRINTING METHOD

CROSS-REFERENCE TO RELATED APPLICATION

This application is a 371 application of the International PCT application serial no. PCT/JP2015/056617, filed on Mar. 6, 2015, which claims the priority benefits of Japan Patent Application No. 2014-049389, filed on Mar. 12, 2014. The entirety of each of the above-mentioned patent applications is hereby incorporated by reference herein and made a part of this specification.

TECHNICAL FIELD

This disclosure relates to an inkjet printing apparatus and an inkjet printing method.

BACKGROUND ART

Conventionally, inkjet printing apparatuses perform a printing operation by prompting a head to discharge inks on a recording medium while reciprocating the head. Some of the inkjet printing apparatuses use inks of ultraviolet curing type as printing inks. The inks of ultraviolet curing type are curable by being irradiated with ultraviolet light.

As described in Patent Literature 1, a recording medium having a print object printed thereon with inks of ultraviolet curing type may have its outermost surface coated with a clear ink to improve in glossiness. In the printing method described in Patent Literature 1, an overprint layer is formed on a tack-dry color ink layer and left standing for a given period of time. Then, the surface of the overprint layer is flattened, and the color ink layer and the overprint layer are then cured.

CITATION LIST

Patent Literature

Patent Literature 1: Japanese Unexamined Patent Publication No. 2010-195002A (published on Sep. 9, 2010)

SUMMARY OF INVENTION

Technical Problems

The color ink layer on the recording medium is formed of ink dots bowed upward in a semi-spherical or an approximate shape. The color ink layer, therefore, has an uneven surface. When the overprint layer is formed on the color ink layer by the printing method described in Patent Literature 1, therefore, such an uneven surface of the color ink layer prevents the surface of the overprint layer from being flattened sufficiently. This may impart non-uniform glossiness to the surface of the recording medium.

In light of the foregoing, the present disclosure provides an inkjet printing apparatus and an inkjet printing method that may produce printed matter that excels in glossiness.

Solutions to the Problems

An inkjet printing apparatus according to one aspect of the present disclosure, in order to solve the problems, is configured to perform a printing operation on a recording medium set on a platen in a plurality of passes. The inkjet printing apparatus includes: a head that reciprocates in a main scanning direction while discharging an ink curable by being irradiated with light on the recording medium; an irradiator having a plurality of irradiation elements divided correspondingly to respective ones of the passes and configured to irradiate the ink on the recording medium with light; and an irradiation controller programmed to control the plurality of irradiation elements. The irradiation controller turns on ones of the plurality of irradiation elements corresponding to the passes before and inclusive of a (n−m)th pass, and turns off or controls ones of the plurality of irradiation elements corresponding to a last (m)th pass to have a lower illuminance than the ones of the plurality of irradiation elements corresponding to the passes before and inclusive of the (n−m)th pass, where the number of the plurality of passes is n (m is an integer smaller than n and greater than or equal to 1), so that the ink discharged in the last (m)th pass on the recording medium remains uncured.

According to the above configuration, a matte ink layer formed in the (n−m)th pass may smooth any unevenness on the surface of the recording medium (or its underlayer). As a result, the ink discharged in the last (m)th pass and still wet may spread on the recording medium or the underlayer, forming a glossy ink layer having a flattened surface. Thus, a printed matter that excels in glossiness may be obtained.

The inkjet printing apparatus according to one aspect of the present disclosure may further include another irradiator having another plurality of irradiation elements different from the plurality of irradiation elements. The plurality of irradiation elements of the another irradiator irradiate the ink on the recording medium with light after the printing operation in the n number of passes on the recording medium is completed to cure the ink discharged on the recording medium in the last (m)th pass and still uncured. The another irradiator is disposed on a downstream side of the irradiator in a sub scanning direction orthogonal to the main scanning direction. The another irradiator may have another plurality of irradiation elements different from the plurality of irradiation elements, and irradiates the ink on the recording medium with light in a plurality of passes after the printing operation in the n number of passes on the recording medium is completed to cure the ink discharged on the recording medium in the last (m)th pass and still uncured.

According to the above configuration, the inkjet printing apparatus may flatten the surface of the glossy ink layer formed on the outermost surface of the recording medium and thereby enhance a gloss finish effect on the glossy ink layer, while affording full cure of the glossy ink layer. By irradiating the ink with light using the irradiator in a plurality of passes, full cure of the ink left uncured on the recording medium may be finely controlled.

Further, in the inkjet printing apparatus according to one aspect of the present disclosure, the another irradiator has a plurality of rows each including the another plurality of irradiation elements arranged in the main scanning direction, the plurality of rows extend in the sub scanning direction orthogonal to the main scanning direction, the irradiation controller turns on ones of the another plurality of irradiation elements in one of the plurality of rows, and the irradiation controller turns off or controls ones of the another plurality of irradiation elements in the other one of the rows to have a lower illuminance than the turned-on ones of the plurality of irradiation elements.

According to the above configuration, the plurality of irradiation elements in one of the rows are turned on, while the plurality of irradiation elements in the other one of the rows are turned off or controlled to have a lower illuminance. This may lower the illuminance of the irradiator. Therefore, the glossy ink layer formed on the outermost surface of the recording medium is cured by weak light. This may prevent overcure of the ink and thereby avoid shrinkage on curing, consequently suppressing possible creases on the surface.

Further, in the inkjet printing apparatus according to one aspect of the present disclosure, the irradiation controller, in alternate ones of the rows, turns on the another plurality of irradiation elements per row, and turns off or controls the another plurality of irradiation elements to have a lower illuminance than the turned-on ones of the plurality of irradiation elements per row.

According to the above configuration, the emitted light is intensified on the border between two consecutive rows of irradiation elements emitting light. By thus having the plurality of irradiation elements in alternate ones of the rows be turned on per row, and turned off or controlled have a lower illuminance per row, the emitted light may disperse, providing for a uniform illuminance.

Still further, in the inkjet printing apparatus according to one aspect of the present disclosure, the irradiator has a plurality of rows each including the plurality of irradiation elements arranged in the main scanning direction, the plurality of rows extend in the sub scanning direction orthogonal to the main scanning direction, the irradiation controller turns on ones of the plurality of irradiation elements corresponding to the last (m)th pass in one of the plurality of rows, and the irradiation controller turns off or controls ones of the plurality of irradiation elements corresponding to the last (m)th pass in the other one of the rows to have a lower illuminance than the turned-on ones of the plurality of irradiation elements.

According to the above configuration, the irradiation controller of this inkjet printing apparatus, among the irradiation elements corresponding to the last (m)th pass in the irradiator, turns on the plurality of irradiation elements in one of the rows, and turn off the plurality of irradiation elements in the other one of the rows. This may suppress the illuminance of a portion of the irradiator corresponding to the last (m)th pass.

Still further, in the inkjet printing apparatus according to one aspect of the present disclosure, the irradiation controller, in alternate ones of the rows, turns on ones of the plurality of irradiation elements corresponding to the last (m)th pass per row, and turns off or controls ones of the plurality of irradiation elements corresponding to the last (m)th pass to have a lower illuminance than the turned-on ones of the plurality of irradiation elements per row.

According to the above configuration, the emitted light is intensified on the border between two consecutive rows of the plurality of irradiation elements emitting light. By thus having the irradiation elements in alternate ones of the rows be turned on per row, and turned off or controlled have a lower illuminance per row, the emitted light may disperse, providing for a uniform illuminance.

Still further, in the inkjet printing apparatus according to one aspect of the present disclosure, the another irradiator is two irradiators arranged in the main scanning direction, the another irradiators are disposed at right and left positions in a view from the head in the sub scanning direction, and any one of the rows in one of the another irradiators in which the another plurality of irradiation elements are turned on and any one of the rows in the other one of the another irradiators in which the plurality of irradiation elements are turned off or controlled to have a lower illuminance than the turned-on ones of the plurality of irradiation elements are disposed so as to face each other in the main scanning direction.

According to the above configuration, the inkjet printing apparatus may cure the glossy ink layer formed on the recording medium with a uniform illuminance.

Still further, in the inkjet printing apparatus according to one aspect of the present disclosure, the irradiation controller selectively turns on and turns off the another plurality of irradiation elements or adjusts the illuminance of the another plurality of irradiation elements. The irradiation controller may selectively turn on and turn off each one of the another plurality of irradiation elements or adjust the illuminance of each one of the another plurality of irradiation elements. The irradiation controller may selectively turn on and turn off the another plurality of irradiation elements for each one of the rows or adjust the illuminance of the another plurality of irradiation elements for each one of the rows.

According to the above configuration, the irradiation of light from the another irradiator may be controlled by selectively turning on and turning off the another plurality of irradiation elements or by adjusting their degrees of illuminance. By selectively turning on and off each one of the another plurality of irradiation elements or by adjusting the illuminance of each one of the another plurality of irradiation elements, the proportion of the irradiation elements currently turned on may be changed or the illuminance of each irradiation element may be changed. The irradiation of light may accordingly be controlled in a finely-tuned manner. The another plurality of irradiation elements may be selectively turned on and turned off for each one of the rows, or their degrees of illuminance may be adjusted for each one of the rows. This enables per-row control of the irradiation elements to facilitate the light irradiation control, making it unnecessary to equip the irradiation controller with a complicated control circuit.

Still further, in the inkjet printing apparatus according to one aspect of the present disclosure, the irradiation controller outputs binary digital signals to the another plurality of irradiation elements to selectively turn on and off the another plurality of irradiation elements, or the irradiation controller regulates values of electric current to be supplied to the another plurality of irradiation elements to adjust their degrees of illuminance.

According to the above configuration, the irradiation elements are controlled based on the binary digital signals, i.e., the irradiation elements are simply controlled to be turned on and off. This may facilitate the light irradiation control, making it unnecessary to equip the irradiation controller with a complicated control circuit. The illuminance may be controlled in a finely-tuned manner by adjusting the values of electric current to be supplied to the irradiation elements. This may allow the irradiation elements to have a desired illuminance or an approximate illuminance.

The inkjet printing apparatus according to one aspect of the present disclosure may further include: a transport unit that transports the recording medium from a position facing the irradiator after the printing operation in the n number of passes on the recording medium is completed; and another irradiator disposed on a downstream side of the irradiator in a direction in which the recording medium is transported by the transport unit. The another irradiator irradiates the ink on the recording medium with light.

According to the above configuration, the inkjet printing apparatus may flatten the surface of the glossy ink layer formed on the outermost surface of the recording medium and thereby enhance a gloss finish effect on the glossy ink layer, while affording full cure of the glossy ink layer.

Still further, in the inkjet printing apparatus according to one aspect of the present disclosure, a colored layer is formed from a color ink and a coating layer for the colored layer is partly formed from a coating ink in the passes before and inclusive of the (n−m)th pass, and a remaining part of the coating layer is formed in the last (m)th pass on a formed part of the coating layer.

According to the above configuration, by forming the matte and glossy ink layers as a coating layer on the colored layer, the recording medium may be coated with an overcoat that excels in glossiness.

Still further, in order to solve the above problems, one aspect of the present disclosure provides an inkjet printing method of performing a printing operation on a recording medium set on a platen in a plurality of passes. The inkjet printing method includes: an ink discharge step of discharging an ink curable by being irradiated with light on the recording medium; and an irradiating step of irradiating the ink on the recording medium with light emitted from a plurality of irradiation elements corresponding to respective ones of the passes. In the irradiating step, ones of the plurality of irradiation elements corresponding to the passes before and inclusive of a (n−m)th pass are turned on, and ones of the plurality of irradiation elements corresponding to a last (m)th pass are turned off or controlled to have a lower illuminance than the ones of the plurality of irradiation elements corresponding to the passes before and inclusive of the (n−m)th pass, where the number of the plurality of passes is n (m is an integer smaller than n and greater than or equal to 1),so that the ink discharged in the last (m)th pass on the recording medium remains uncured.

According to the above configuration, this inkjet printing method may exert the same effects as exerted by the inkjet printing apparatus according to one aspect of the present disclosure.

Effect of the Invention

According to one aspect of the present disclosure thus far described, the matte ink layer formed in the (n−m)th pass may smooth any unevenness on the surface of the recording medium (or its underlayer). As a result, the ink discharged in the last (m)th pass and still wet may spread on the recording medium or the underlayer, forming a glossy ink layer having a flattened surface. Thus, a printed matter that excels in glossiness may be obtained.

DESCRIPTION OF EMBODIMENTS

First Embodiment

[Inkjet Printing Apparatus 1]

Figure 1:
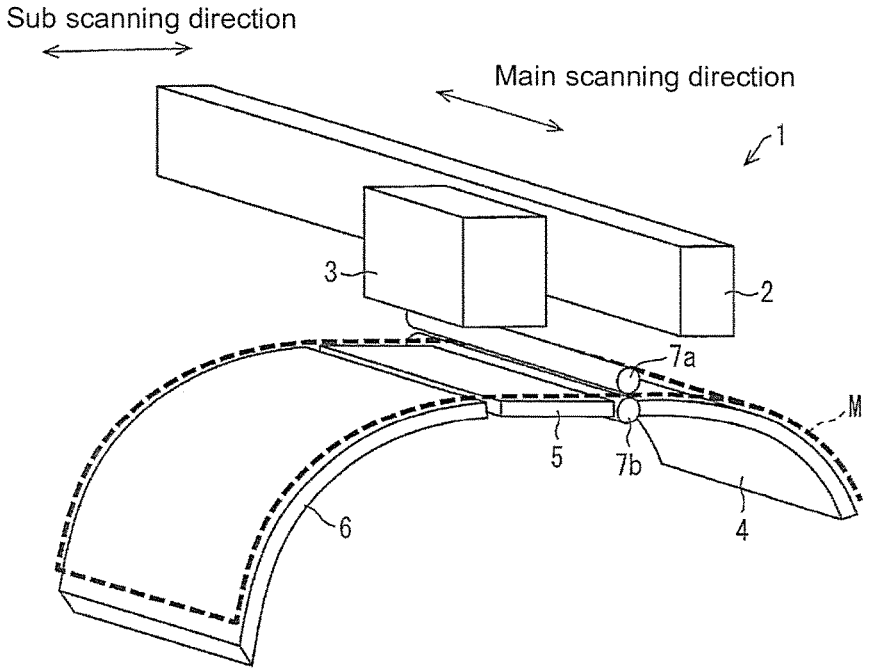
FIG. 1 is a perspective view in cross section of the internal structure of an inkjet printing apparatus according to one embodiment of the present disclosure.
Figure 2:
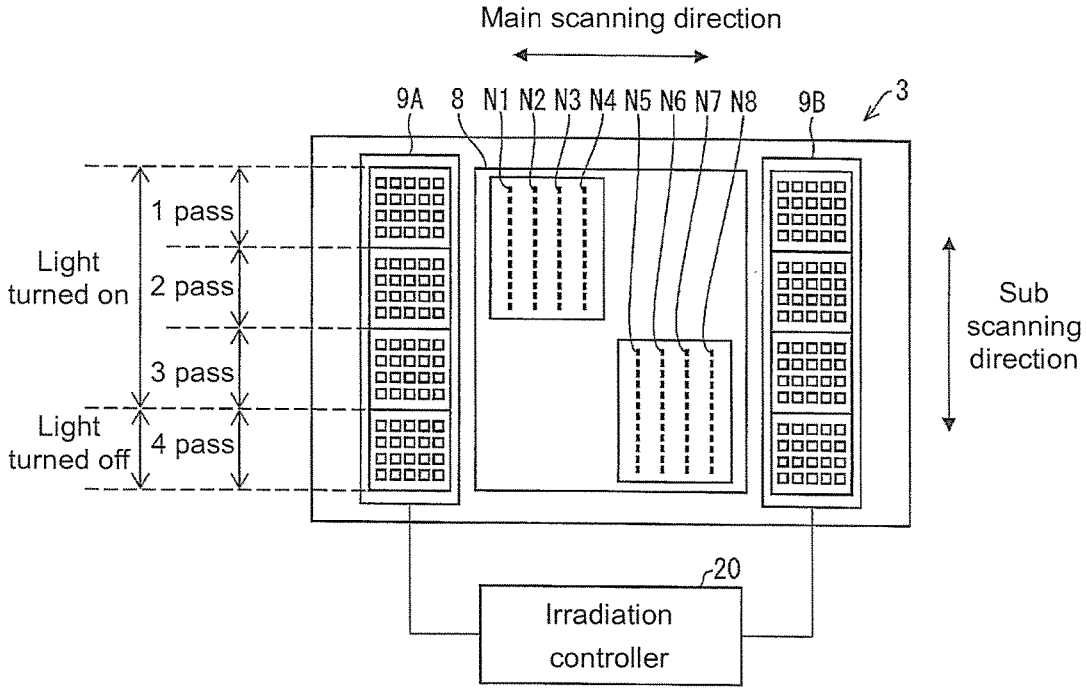
FIG. 2 is a schematic structural view of a carriage in the inkjet printing apparatus according to one embodiment of the present disclosure.

An inkjet printing apparatus according to a first embodiment of the present disclosure is hereinafter described in detail referring to FIGS. 1 and 2. FIG. 1 is a perspective view in cross section of the internal structure of an inkjet printing apparatus 1. FIG. 2 is a schematic structural diagram of a carriage 3 in the inkjet printing apparatus 1.

As illustrated in FIG. 1, the inkjet printing apparatus 1 has a Y bar 2, the carriage 3, a pre-printing platen 4, a printing platen 5 (platen), an after-printing platen 6, a driving roller 7*a*, and a driven roller 7*b*. The inkjet printing apparatus 1 further has an irradiation controller 20, as illustrated in FIG. 2. The inkjet printing apparatus 1 is a multi-pass inkjet printer that performs a printing operation on a medium M (recording medium) in a plurality of passes.

[Y bar 2]

The Y bar 2 is extending in one direction. The direction in which the Y bar 2 is extending coincides with the main scanning direction of the inkjet printing apparatus 1. The main scanning direction refers to a direction parallel to a direction along the surface of the printing platen 5. The sub scanning direction refers to a direction perpendicular to the main scanning direction. The medium M is transported in the sub scanning direction.

[Carriage 3]

As illustrated in FIG. 2, the carriage 3 has a head 8, a right irradiator 9A (irradiator), and a left irradiator 9B (irradiator). The carriage 3 is attached to the Y bar 2 and reciprocates in the main scanning direction. The carriage 3, by way of its reciprocating motion, moves relative to the printing platen 5, allowing the head 8, described later, to move relative to the printing platen 5. This embodiment describes an example in which the head 8 moves in the main scanning direction but the medium M does not move in the main scanning direction. The inkjet printing apparatus disclosed herein is not limited to the example but may include an inkjet printing apparatus having a fixed head and structured to reciprocate a medium in the main scanning direction.

[Head 8]

The head 8 discharges inks curable by being irradiated with light on the medium M. Specifically, the head 8 has a plurality of nozzle arrays N1 to N8. The nozzle arrays N1 to N8 each have a plurality of nozzles, through which the inks are discharged. The inks may be any inks curable by being irradiated with light emitted from the right irradiator 9A and the left irradiator 9B. For example, the light and the inks may be preferably ultraviolet light and inks of ultraviolet curing type, respectively. In this embodiment, the head 8 discharges inks of ultraviolet curing type.

The plurality of nozzle arrays N1 to N8 are arranged in the main scanning direction. For example, the inks discharged from the nozzle arrays N1 to N8 may be color inks including cyan (C), magenta (M), yellow (Y), and black (K) inks, and a white (W) ink, or a clear (CL) ink that forms a protective layer or a primer (P) that forms an adhesive layer.

The plurality of nozzle arrays N1 to N8 are divided in regions respectively corresponding to different passes. In the example illustrated in FIG. 2, an upper-half region of the nozzle arrays N1 to N4 on the drawing in the sub scanning direction is corresponding to the first pass, while a lower-half region of these nozzle arrays is corresponding to the second pass. Similarly, an upper-half region of the nozzle arrays N5 to N8 on the drawing in the sub scanning direction is corresponding to the third pass, while a lower-half region of these nozzle arrays is corresponding to the fourth pass.

[Platen]

The pre-printing platen 4, printing platen 5, after-printing platen 6 are tables on which the medium M is set. The printing platen 5 is disposed at a position facing the carriage 3. The pre-printing platen 4 is disposed at a position on the upstream side relative to the printing platen 5 in the transport direction of the medium M (sub scanning direction). The after-printing platen 6 is disposed at a position on the downstream side of the printing platen 5 in the transport direction of the medium M (sub scanning direction).

[Roller]

The driving roller 7*a* is a member used to transport the medium M in the sub scanning direction. The driving roller 7*a* includes a roller. The driven roller 7*b* is a member that assists the transport of the medium M by the driving roller 7*a*. When the driving roller 7*a* is rotated, the driven roller 7*b* is thereby driven to rotate. The rotations of these rollers move the medium M.

[Right Irradiator 9A and Left Irradiator 9B]

The right irradiator 9A and the left irradiator 9B emit light to cure the inks discharged on the medium M from the head 8. The light is not particularly limited in so far as the inks discharged from the head 8 are thereby curable. For example, the light and the inks may be preferably ultraviolet light and inks of ultraviolet curing type, respectively. In this embodiment, the right irradiator 9A and the left irradiator 9B emit ultraviolet light.

The right irradiator 9A and the left irradiator 9B are arranged in the main scanning direction and spaced at an interval that allows the head 8 to be interposed therebetween. The right irradiator 9A and the left irradiator 9B move in the same direction as the moving direction of the head 8, i.e., main scanning direction. As the head 8 moves while discharging the inks, the discharged inks are immediately irradiated with ultraviolet light emitted from the right irradiator 9A and the left irradiator 9B.

The right irradiator 9A is disposed at a position on the right side (left side on the drawing) of the head 8. The right irradiator 9A includes a plurality of irradiation elements, for example, LEDs, emitting ultraviolet light. Similarly, the left irradiator 9B is disposed at a position on the left side (right side on the drawing) of the head 8. The left irradiator 9B includes a plurality of irradiation elements, for example, LEDs, emitting ultraviolet light. The right irradiator 9A and the left irradiator 9B each have a plurality of rows each including the plurality of irradiation elements arranged in the main scanning direction. The rows of these irradiation elements extend in the sub scanning direction. The plurality of irradiation elements of the right irradiator 9A and the left irradiator 9B are divided correspondingly to respective ones of the passes. In the example illustrated in FIG. 2, the plurality of irradiation elements of the right irradiator 9A and the left irradiator 9B are divided into four, which are, from the upper side on the drawing, respectively corresponding to the first pass, second pass, third pass, and fourth pass.

[Irradiation Controller 20]

The irradiation controller 20 controls the irradiation of light by the right irradiator 9A and the left irradiator 9B. For example, the irradiation controller 20 selectively turns on and off the irradiation elements of the right irradiator 9A and the left irradiator 9B or adjusts their degrees of illuminance. The irradiation controller 20 can turn on and off the irradiation elements of the right irradiator 9A and the left irradiator 9B independently from each other.

The irradiation controller 20, by controlling the supply of electric current to the irradiation elements of the right irradiator 9A and the left irradiator 9B, can selectively turn on and off the irradiation elements of these irradiators. Specifically, the irradiation controller 20 selectively turns on and off the irradiation elements of the right irradiator 9A and the left irradiator 9B by outputting binary digital signals to these irradiation elements. In this case, the irradiation elements are controlled based on the binary digital signals, i.e., the irradiation elements are simply controlled to be turned on and off. This may facilitate the light irradiation control, making it unnecessary to equip the irradiation controller 20 with a complicated control circuit.

Further, the irradiation controller 20 may adjust degrees of illuminance of the irradiation elements in the right irradiator 9A and the left irradiator 9B by adjusting values of electric current to be supplied to these irradiation elements. The illuminance may be controlled in a finely-tuned manner by thus adjusting the values of electric current to be supplied to the irradiation elements. This may allow the irradiation elements to have a desired illuminance or an approximate illuminance. In this embodiment, the irradiation controller 20 controls the ON and OFF of the irradiation elements of the right irradiator 9A and the left irradiator 9B.

The irradiation controller 20 can collectively turn on and off the whole irradiation elements of the right irradiator 9A and the left irradiator 9B or adjust their degrees of illuminance. The present disclosure, however, is not limited to such a collective control of the irradiation elements. For example, the irradiation controller 20 may selectively turn on and off each one of the irradiation elements in the right irradiator 9A and the left irradiator 9B or adjust the illuminance of each irradiation element. By changing the proportion of the irradiation elements in the right and left irradiators 9A and 9B currently turned on or by adjusting the illuminance of each irradiation element, the irradiation of light may be controlled in a finely-tuned manner.

For example, the irradiation controller 20 may selectively turn on and off the irradiation elements or adjust the illuminance of the irradiation elements for each of the rows arranged in the main scanning direction in the right irradiator 9A and the left irradiator 9B. This enables per-row control of the irradiation elements to facilitate the light irradiation control, making it unnecessary to equip the irradiation controller 20 with a complicated control circuit.

[Inkjet Printing Method]

An inkjet printing method performed by the inkjet printing apparatus 1 is hereinafter described referring to FIGS. 3A to 3D and FIG. 2 described earlier. FIGS. 3A to 3D are schematic diagrams, illustrating the inkjet printing method performed by the inkjet printing apparatus 1. The inkjet printing method described below performs a printing operation in four passes (by adherently depositing the inks four times), as illustrated in FIG. 2. In this inkjet printing apparatus, the color inks; cyan (C), magenta (M), yellow (Y), and black (K) inks are discharged from the nozzle arrays N1 to N4, and the clear (CL) ink is discharged from the nozzle arrays N5 to N8.

First, the driving roller 7*a* and the driven roller 7*b* are rotated, and the medium M is thereby transported onto the printing platen 5. Then, the inks are discharged through the nozzles on the lower surface of the head 8 during the reciprocating motion of the carriage 3 in the main scanning direction along the Y bar 2, and the discharged inks are adhered to the medium M (ink discharge step). During this scan, the right irradiator 9A and the left irradiator 9B are irradiating the medium M with ultraviolet light to cure the inks adhered to the medium M.

[Step of Forming Color Ink Layer P1]

When the carriage 3 starts to move to right (to left on the drawing), the color inks are discharged solely from the upper-half region, on the drawing, of the nozzle arrays N1 to N4 in the sub scanning direction (region corresponding to the first pass). From the carriage 3, information indicating the start of its movement to right is transmitted to the irradiation controller 20. The irradiation controller 20, based on the received information, turns on the plurality of irradiation elements of the right irradiator 9A and the left irradiator 9B corresponding to the first pass while the color inks for the first pass are being discharged from the head 8. In the first pass, the medium M is irradiated with ultraviolet light emitted from the right irradiator 9A, and the color inks for one pass discharged from the head 8 are adhered to the medium M. Then, the medium M is further irradiated with ultraviolet light emitted from the left irradiator 9B.

In the first pass, the medium M is moved forward (sub scanning direction) in the width of one pass after the arrival of the carriage 3 at the right end of the medium M. When the carriage 3 starts to move to left (to right on the drawing), the color inks are discharged solely from the lower-half region, on the drawing, of the nozzle arrays N1 to N4 in the sub scanning direction (region corresponding to the second pass). From the carriage 3, information indicating the start of its movement to left is transmitted to the irradiation controller 20. The irradiation controller 20, based on the received information, turns on the plurality of irradiation elements of the right irradiator 9A and the left irradiator 9B corresponding to the second pass while the color inks for the second passes are being discharged from the head 8.

Figure 3A:
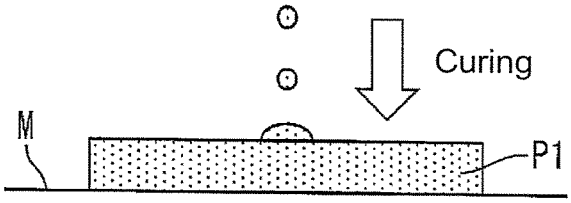
FIGS. 3A to 3D are schematic diagrams, illustrating an inkjet printing method performed by the inkjet printing apparatus according to one embodiment of the present disclosure.

In the second pass, the medium M is irradiated with ultraviolet light emitted from the left irradiator 9B, and the color inks for one pass discharged from the head 8 are adhered to the medium M. Then, the medium M is further irradiated with ultraviolet light emitted from the right irradiator 9A. The printing operation performed in the passes before and inclusive of the second pass forms a color ink layer P1 on the medium M, as illustrated in FIG. 3A.

[Step of Forming First Clear Ink Layer P2]

In the second pass, the medium M is moved forward in the width of one pass after the arrival of the carriage 3 at the left end of the medium M, as done in the first pass. When the carriage 3 starts to move to right, the clear ink is discharged solely from the upper-half region, on the drawing, of the nozzle arrays N5 to N8 in the sub scanning direction (region corresponding to the third pass). From the carriage 3, information indicating the start of its movement to right is transmitted to the irradiation controller 20. The irradiation controller 20, based on the received information, turns on the plurality of irradiation elements of the right irradiator 9A and the left irradiator 9B corresponding to the third pass while the clear ink for the third pass is being discharged from the head 8.

Figure 3B:
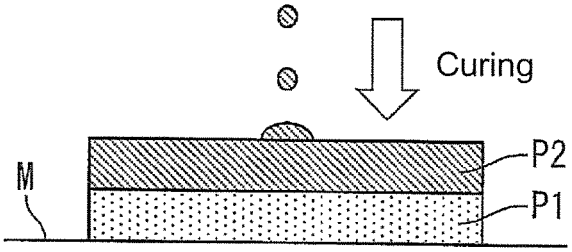

In the third pass, the clear ink for one pass discharged from the head 8 is adhered to the medium M after the medium M is irradiated with ultraviolet light emitted from the right irradiator 9A. Then, the medium M is further irradiated with ultraviolet light emitted from the left irradiator 9B. The clear ink applied on the color ink layer P1 on the medium M is irradiated with light from the right and left irradiators 9A and 9B and thereby instantly cured. As a result, the first clear ink layer P2; matte ink layer, is formed on the color ink layer P1 on the medium M, as illustrated in FIG. 3B.

[Step of Forming Second Clear Ink Layer P3]

In the third pass, the medium M is moved forward in the width of one pass after the arrival of the carriage 3 at the right end of the medium M, as done in the second pass. When the carriage 3 starts to move to left, the clear ink is discharged solely from the lower-half region, on the drawing, of the nozzle arrays N5 to N8 in the sub scanning direction (region corresponding to the fourth pass). From the carriage 3, information indicating the start of its movement to left is transmitted to the irradiation controller 20. The irradiation controller 20, based on the received information, turns off the plurality of irradiation elements of the right irradiator 9A and the left irradiator 9B corresponding to the fourth pass while the clear ink for the fourth pass is being discharged from the head 8.

Figure 3C:
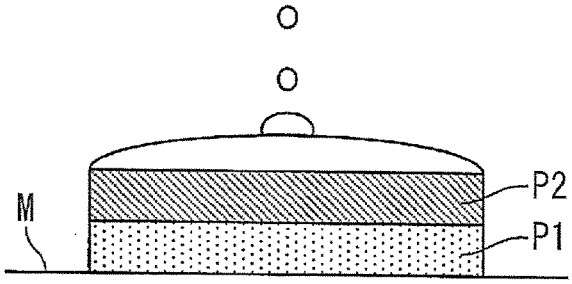
Figure 3D:
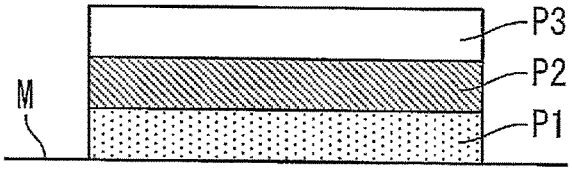

In the fourth pass, the clear ink for one pass discharged from the head 8 is adhered to the medium M. In this pass, however, the medium M is neither irradiated before the ink adhesion with ultraviolet light from the right irradiator 9A nor irradiated thereafter with ultraviolet light from the left irradiator 9B. As illustrated in FIG. 3C, therefore, the clear ink applied on the first clear ink layer P2 on the medium M is still wet, spreading on the first clear ink layer P2, without being immediately cured by the right and left irradiators 9A and 9B. As a result, the second ink layer P3; glossy ink layer having an adequately flattened surface, is formed on the first clear ink layer P2 on the medium M, as illustrated in FIG. 3D.

Thus, the matte first clear ink layer P2 formed in the third pass may smooth any unevenness on the surface of the color ink layer P1 formed in the passes before and inclusive of the second pass. This may allow the clear ink discharged in the last fourth pass and still wet to spread on the surface of the smoothed surface, forming the second clear ink layer P3 having a flattened surface. Even if the color ink layer P1 has an uneven surface, therefore, the surface of the second clear ink layer P3, constituting the outermost surface, may be flattened. As a result, a printed matter that excels in glossiness may be obtained.

As described so far, the inkjet printing apparatus 1, by turning on the plurality of irradiation elements corresponding to the passes before and inclusive of the third pass and turning off the plurality of irradiation elements corresponding to the last fourth pass, may obtain a printed matter that excels in glossiness. This structural feature of the inkjet printing apparatus 1 may be rephrased that, where the number of a plurality of passes is n (m is an integer smaller than n and greater than or equal to 1), the plurality of irradiation elements corresponding to passes before and inclusive of a (n−m)th pass are turned on, and the plurality of irradiation elements corresponding to a last (m)th pass are turned off, so that the ink discharged on the medium M in the last (m)th pass is left uncured.

In the passes before and inclusive of the (n−m)th pass, therefore, the color ink layer (colored layer) is formed from the color inks (coloring inks), and the clear ink layer (coating layer) is partly formed from the clear ink (ink) as a coating layer for the color ink layer. Then, the rest of the clear ink layer is formed on the formed part of the clear ink layer (coating layer). In the inkjet printing apparatus thus characterized, a matte ink layer formed in the (n−m)th pass may smooth any unevenness on the surface of the recording medium (or its underlayer). As a result, the ink discharged in the last (m)th pass and still wet may spread on the recording medium or the underlayer, forming a glossy ink layer having a flattened surface. As a result, a printed matter that excels in glossiness may be obtained.

By forming the matte and glossy ink layers using the clear ink, the recording medium M may be coated with an overcoat that excels in glossiness. The present disclosure, however, may form the matte and glossy ink layers using the color inks, instead of the clear ink.

The layer structures of ink layers formed on the medium M in FIGS. 3A to 3D are illustrated as a non-limiting example. Other examples of the layer structure may include a two-layered structure consisting of one matte ink layer and one glossy ink layer using the color inks or the clear ink, or a four-layer structure consisting of an underlayer using a white ink, a color ink layer using a color ink(s), and a matte ink layer and a glossy ink layer using the clear ink.

The number of passes in which the irradiation controller 20 turns off the plurality of irradiation elements (m number of passes) may be a preset number inputted beforehand by a user to the inkjet printing apparatus 1, or a number set by the irradiation controller 20 depending on, for example, the degree of resolution of an image to be printed.

As described earlier, the irradiation controller 20 may adjust degrees of the illuminance of the irradiation elements in the right irradiator 9A and the left irradiator 9B. The irradiation controller 20 may control the plurality of irradiation elements corresponding to the last (m)th pass in the right irradiator 9A and the left irradiator 9B to have a lower illuminance than the plurality of irradiation elements corresponding to the passes before and inclusive of the (n−m)th pass in the right irradiator 9A and the left irradiator 9B, so that the ink discharged on the medium M in the last (m)th pass is left uncured. As a result, the ink discharged in the last (m)th pass and still wet may spread on the recording medium or the underlayer, forming a glossy ink layer having a flattened surface. Thus, a printed matter that excels in glossiness may be obtained.

[Ink Discharge Amount of the Head 8]

The thicknesses of the matte ink layer and the glossy ink layer are now described. The matte ink layer, if too thin, may be affected, while being formed, by the uneven surface of the medium M (or its underlayer). In the end, the uneven surface of the medium M may fail to be adequately smoothed. The glossy ink layer, if too thick, may be shrunk on curing and may have creases on its surface. The thicknesses of the matte and glossy ink layers may preferably be decided in the perspective of these issues.

In the inkjet printing apparatus 1 according to this embodiment, the thicknesses of the matte and glossy ink layers are adjusted by regulating an ink amount discharged from the head 8. Preferably, the matte ink layer may be formed of 20% to 40% of a regular ink discharge amount, and the glossy ink layer may be formed of 60% to 80% of the ink discharge amount, or the matte ink layer may be formed of 30% of the ink discharge amount, and the glossy ink layer may be formed of 70% of the ink discharge amount. In case the matte ink layer is formed in three passes, and the glossy ink layer is then formed in three passes, the matte ink layer is formed of 10% of the ink discharge amount in each of the former three passes, while the glossy ink layer is formed of 23.3% of the ink discharge amount in each of the latter three passes. In this manner, the matte ink layer formed of 30% of the ink discharge amount and the glossy ink layer formed of 70% of the ink discharge amount may be obtained.

As for the matte ink layer and the glossy ink layer, their suitable thicknesses may differ depending on materials of the medium M and ink materials. To this end, the inkjet printing apparatus 1 further has a discharge controller (a discharge control unit, not illustrated in the drawing). The discharge controller controls the ink discharge amount of the head 8 in each pass in order to change the thicknesses of the matte ink layer and the glossy ink layer. In case the matte ink layer is formed of 30% of the ink discharge amount and the glossy ink layer is formed of 70% of the ink discharge amount in the example illustrated in FIG. 2, the first clear ink layer P2 is formed from the clear ink discharged by 30% of the ink discharge amount in the third pass, and the second clear ink layer P3 is formed from the clear ink discharged by 70% of the ink discharge amount in the fourth pass.

To change the thicknesses of the matte and glossy ink layers, a constant ink discharge amount may be defined for each pass, and the numbers of passes used to form the matte and glossy ink layers may be changed. This, however, increases an amount of time when the right and left irradiators 9A and 9B are turned off because the glossy ink layer is formed in a greater number of passes than the matte ink layer. While the glossy ink layer is being formed, the uncured ink may be exposed to air for an extended period of time, which may incur dust adhesion to the surface of the glossy ink layer.

To avoid that, the number of passes used to form the glossy ink layer may be reduced by changing the ink discharge amount for each pass. As a result, the uncured ink may be exposed to air only for a short period of time when the glossy ink layer is formed. This may avoid dust adhesion to the surface of the glossy ink layer.

[Adjustment of Illuminance]

As described earlier, the irradiation controller 20 may adjust the illuminance of the irradiation elements. Specifically, the irradiation controller 20 may control the plurality of irradiation elements corresponding to the last (m)th pass in the right and left irradiators 9A and 9B to have a lower illuminance than the plurality of irradiation elements corresponding to the passes before and inclusive of the (n−m)th pass in the right and left irradiators 9A and 9B, so that the ink discharged on the medium M in the last (m)th pass is left uncured. In this instance, values of electric current supplied to the plurality of irradiation elements corresponding to the last (m)th pass in the right and left irradiators 9A and 9B are preferably controlled to be lower than values of electric current supplied to the plurality of irradiation elements corresponding to the passes before and inclusive of the (n−m)th pass in the right and left irradiators 9A and 9B.

Optionally, the illuminance of the plurality of irradiation elements corresponding to the last (m)th pass in the right and left irradiators 9A and 9B may be adjusted as described below. The right irradiator 9A and the left irradiator 9B each have a plurality of rows each including a plurality of irradiation elements arranged in the main scanning direction. The rows of these irradiation elements extend in the sub scanning direction. The irradiation controller 20, among the plurality of irradiation elements corresponding to the last (m)th pass in the right and left irradiators 9A and 9B, turns on the plurality of irradiation elements in one of the rows, and turns off or controls the plurality of irradiation elements in the other one of the rows to have a lower illuminance than the turned-on ones of the plurality of irradiation elements.

In this inkjet printing apparatus, among the irradiation elements corresponding to the last (m)th pass in the right and left irradiators 9A and 9B, the plurality of irradiation elements in one of the rows are turned on, and the plurality of irradiation elements in the other one of the rows are turned off. This may lower the illuminance in portions of the right and left irradiators 9A and 9B corresponding to the last (m)th pass.

Preferably, the irradiation controller 20, in alternate ones of the rows of the plurality of irradiation elements corresponding to the last (m)th pass in the right and left irradiators 9A and 9B, turns on the plurality of irradiation elements per row, and turns off or controls the plurality of irradiation elements to have a lower illuminance than the turned-on ones of the plurality of irradiation elements per row. The emitted light is intensified on the border between two consecutive rows of the plurality of irradiation elements emitting light. By thus having the irradiation elements in alternate ones of the rows be turned on per row, and turned off or controlled have a lower illuminance per row, the emitted light may disperse, providing for a uniform illuminance.

The irradiation controller 20 may, in alternate ones of the rows of the plurality of irradiation elements corresponding to the last (m)th pass in the right and left irradiators 9A and 9B, turn on the plurality of irradiation elements per row, and controls the irradiation elements to have a lower illuminance than the turned-on ones of the plurality of irradiation elements per row. In this instance, among the plurality of irradiation elements corresponding to the last (m)th pass in the right and left irradiators 9A and 9B, the irradiation controller 20, in alternate ones of the rows, may supply a first electric current to the plurality of irradiation elements per row, and supply a second electric current lower than the first electric current to the plurality of irradiation elements per row.

In alternate ones of the rows of the plurality of irradiation elements corresponding to the last (m)th pass in the right and left irradiators 9A and 9B, the irradiation controller 20 may turn on the irradiation elements per row and turn off the irradiation elements per row. Among the irradiation elements corresponding to the last (m)th pass in the right and left irradiators 9A and 9B, the irradiation controller 20 may turn on and turn off random ones of the irradiation elements. In this inkjet printing apparatus, among the irradiation elements corresponding to the last (m)th pass in the right and left irradiators 9A and 9B, some of the irradiation elements are turned on, and the others turned off, randomly. This may lower the illuminance in portions of the right and left irradiators 9A and 9B corresponding to the last (m)th pass.

Among the irradiation elements corresponding to the last (m)th pass in the right and left irradiators 9A and 9B, the irradiation controller 20 may, in alternate ones of the rows, turn on the plurality of irradiation elements per row, and control the plurality of irradiation elements to have a lower illuminance than the turned-on ones of the irradiation elements per row. Among the irradiation elements corresponding to the last (m)th pass in the right and left irradiators 9A and 9B, the irradiation controller 20 may turn on random ones of the irradiation elements, and controls random ones of the irradiation elements to have a lower illuminance than the turned-on ones of the irradiation elements.

To control some of the irradiation elements to have a lower illuminance than the turned-on ones of the irradiation elements, the irradiation controller 20 may preferably supply, to the irradiation elements lower in illuminance, a voltage smaller than a voltage supplied to the turned-on ones of the plurality of irradiation elements.

Second Embodiment

Figure 4:
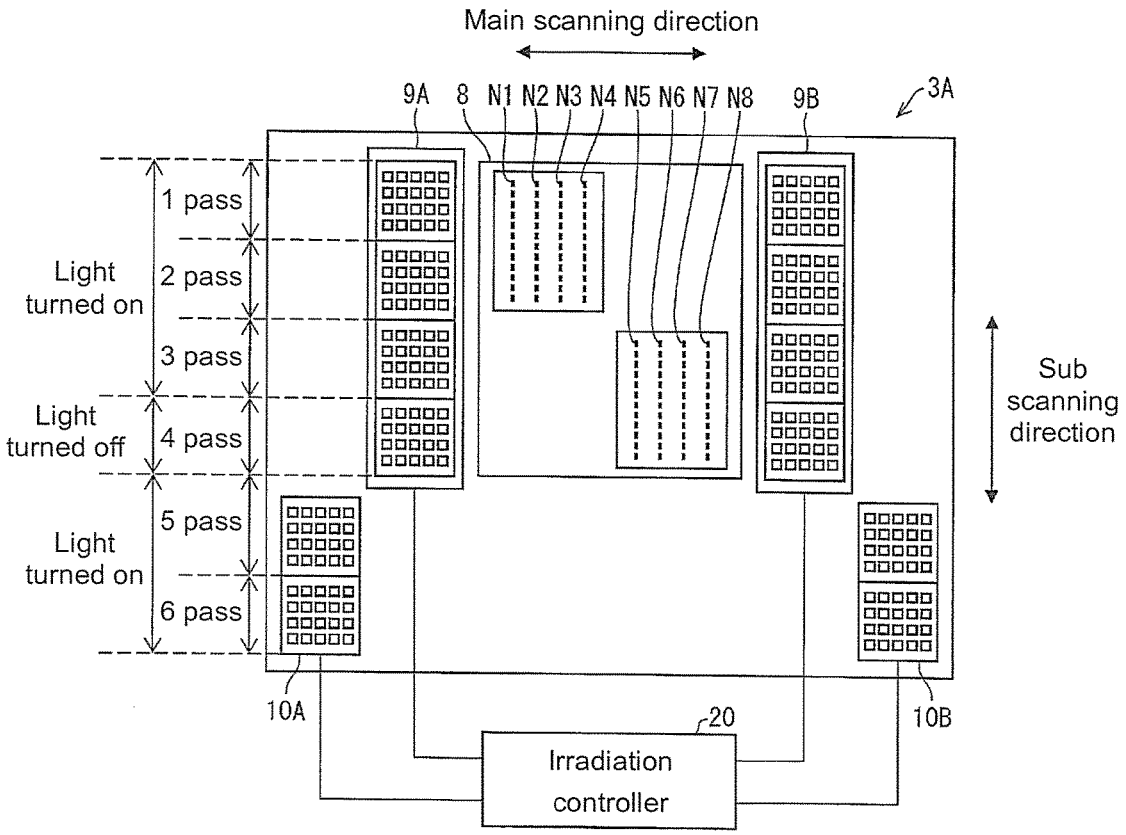
FIG. 4 is a schematic structural view of a carriage in an inkjet printing apparatus according to another embodiment of the present disclosure.

An inkjet printing apparatus according to a second embodiment of the present disclosure is hereinafter described in detail referring to FIG. 4. FIG. 4 is a schematic structural diagram of a carriage 3A of the inkjet printing apparatus according to this embodiment. Any structural parts functionally and operationally similar to those of the first embodiment are illustrated with the same reference signs, description of which is omitted.

[Carriage 3A]

As illustrated in FIG. 4, the carriage 3A has a head 8, a right irradiator 9A (irradiator), a left irradiator 9B (irradiator), and irradiators 10A and 10B (another irradiator). As with the right and left irradiators 9A and 9B, the irradiators 10A and 10B irradiate the ink discharged on the medium M from the head 8 with ultraviolet light. The light is not particularly limited in so far as the inks discharged from the head 8 are thereby curable. For example, the light and the inks may be preferably ultraviolet light and inks of ultraviolet curing type, respectively. In this embodiment hereinafter described, the irradiators 10A and 10B emit ultraviolet light.

The irradiators 10A and 10B are arranged in the main scanning direction and respectively disposed in the lower direction of the right irradiator 9A and the left irradiator 9B (on the downstream side of the right irradiator 9A and the left irradiator 9B in the sub scanning direction). The irradiators 10A and 10B are respectively disposed on the left and right sides when viewed from the head 8 in the sub scanning direction. The irradiators 10A and 10B move in the same direction as the moving direction of the head 8, i.e., main scanning direction. After the printing operation in a plurality of passes is performed on the medium M (recording medium), the inkjet printing apparatus 1 irradiates the medium M with ultraviolet light emitted from the irradiators 10A and 10B to cure the ink discharged (in the fourth pass in this drawing) and still uncured on the medium M. The ultraviolet irradiation using the irradiators 10A and 10B may be performed in either one pass or plural passes (two passes in this drawing). By irradiating the ink with ultraviolet light using the irradiators 10A and 10B in plural passes, curing of the uncured ink on the recording medium M may be finely managed.

The irradiators 10A and 10B each have one or more irradiation elements that emit ultraviolet light. The irradiation elements of the irradiators 10A and 10B may be a plurality of light sources, for example, LEDs, emitting ultraviolet light, or one light source, such as a metal halide lamp. This drawing shows the irradiators 10A and 10B including a plurality of irradiation elements. The plurality of irradiation elements of the irradiators 10A and 10B are divided correspondingly to the respective passes. In the example illustrated in FIG. 4, the plurality of irradiation elements of the irradiator 10A and 10B are divided into two halves, which are, from the upper side on the drawing, respectively corresponding to the fifth pass and the sixth pass.

FIG. 4 illustrates an example in which two irradiators 10A and 10B are mounted in the carriage 3A. This is, however, a non-limiting example of this disclosure. Instead, either one of the two irradiators 10A and 10B may be mounted in the carriage 3A.

[Irradiation Controller 20]

The irradiation controller 20 controls the light irradiation by the irradiators 10A and 10B, as well as the right irradiation by the right irradiator 9A and the left irradiator 9B. For example, the irradiation controller 20 selectively turns on and off the irradiation elements of the irradiators 10A and 1OB or adjusts their degrees of illuminance. The irradiation controller 20 turns on and off the irradiation elements of the irradiators 10A and 10B independently from each other.

The irradiation controller 20, by controlling the supply of electric currents to the irradiation elements of the irradiators 10A and 10B, can selectively turn on and off the irradiation elements of the irradiators 10A and 10B. Specifically, the irradiation controller 20 selectively turns on and off the irradiation elements of the irradiators 10A and 10B by outputting binary digital signals to these irradiation elements. In this instance, the irradiation elements are controlled based on the binary digital signals, i.e., the irradiation elements are simply controlled to be turned on and off. This may facilitate the light irradiation control, making it unnecessary to equip the irradiation controller 20 with a complicated control circuit.

Further, the irradiation controller 20 may adjust the illuminance of the irradiation elements of the irradiator 10A and 10B by adjusting values of electric current to be supplied to these irradiation elements. The illuminance may be controlled in a finely-tuned manner by thus adjusting the values of electric current to be supplied to the irradiation elements. This may allow the irradiation elements to have a desired illuminance or an approximate illuminance. In this embodiment, the irradiation controller 20 controls the ON and OFF of the irradiation elements of the irradiators 10A and 10B.

The irradiation controller 20 can collectively turn on and off the whole irradiation elements of the irradiators 10A and 10B or adjust their degrees of illuminance. This disclosure, however, is not limited to such a collective control of the irradiation elements. For example, the irradiation controller 20 may selectively turn on and off each one of the irradiation elements or adjust the illuminance of each one of the irradiation elements in the irradiators 10A and 10B. By changing the proportion of the irradiation elements of the irradiators 10A and 10B currently turned on or by adjusting the illuminance of each one of these irradiation elements, the irradiation of light may be controlled in a finely-tuned manner.

For example, the irradiation controller 20 may selectively turn on and off the irradiation elements or adjust the illuminance of the irradiation elements for each of the rows arranged in the main scanning direction in the irradiator 10A and the irradiator 10B. This enables per-row control of the irradiation elements to facilitate the light irradiation control, making it unnecessary to equip the irradiation controller 20 with a complicated control circuit.

[Inkjet Printing Method]

An inkjet printing method performed by the inkjet printing apparatus according to this embodiment is hereinafter described referring to FIG. 4 described earlier. The inkjet printing method described below performs a printing operation in four passes (by adherently depositing the inks four times), as illustrated in FIG. 4. In this inkjet printing apparatus, the color inks; cyan (C), magenta (M), yellow (Y), and black (K) inks are discharged from the nozzle arrays N1 to N4, and the clear (CL) ink is discharged from the nozzle arrays N5 to N8.

The printing operation before and inclusive of the fourth pass is the same as that of the first embodiment, description of which is omitted. When the printing operation in four passes is completed, the irradiators 10A and 10B of the inkjet printing apparatus irradiate the ink on the medium M with ultraviolet light. In the fourth pass, the medium M is moved forward (sub scanning direction) in the width of one pass after the arrival of the carriage 3A at the left end of the medium M. When the carriage 3A starts to move to right (left on the drawing), information indicating the start of its movement to right is transmitted from the carriage 3A to the irradiation controller 20. The irradiation controller 20, based on the received information, turns on the plurality of irradiation elements of the irradiators 10A and 10B corresponding to the fifth pass. In the fifth pass, ultraviolet light is emitted from the irradiator 10A onto the medium M, and then emitted from the irradiator 10B onto the medium M.

In the fifth pass, the medium M is moved forward in the width of one pass after the arrival of the carriage 3A at the right end of the medium M. When the carriage 3A starts to move to left (right on the drawing), information indicating the start of its movement to left is transmitted from the carriage 3A to the irradiation controller 20. The irradiation controller 20, based on the received information, turns on the plurality of irradiation elements of the irradiators 10A and 10B corresponding to the sixth pass.

In the sixth pass, ultraviolet light is emitted from the irradiator 10B onto the medium M, and then emitted from the irradiator 10A onto the medium M. When the printing operation in the fifth and sixth passes is over, the clear ink discharged in the fourth pass and still uncured on the medium M is irradiated with light to be cured. In this manner, the surface of the second clear ink layer P3 formed on the outermost surface of the medium M may be flattened so as to have a remarkable gloss finish effect, while, at the same time, the second clear ink layer P3 may be fully cured.

[Irradiation Control by Irradiation Controller 20]

Figure 5A:
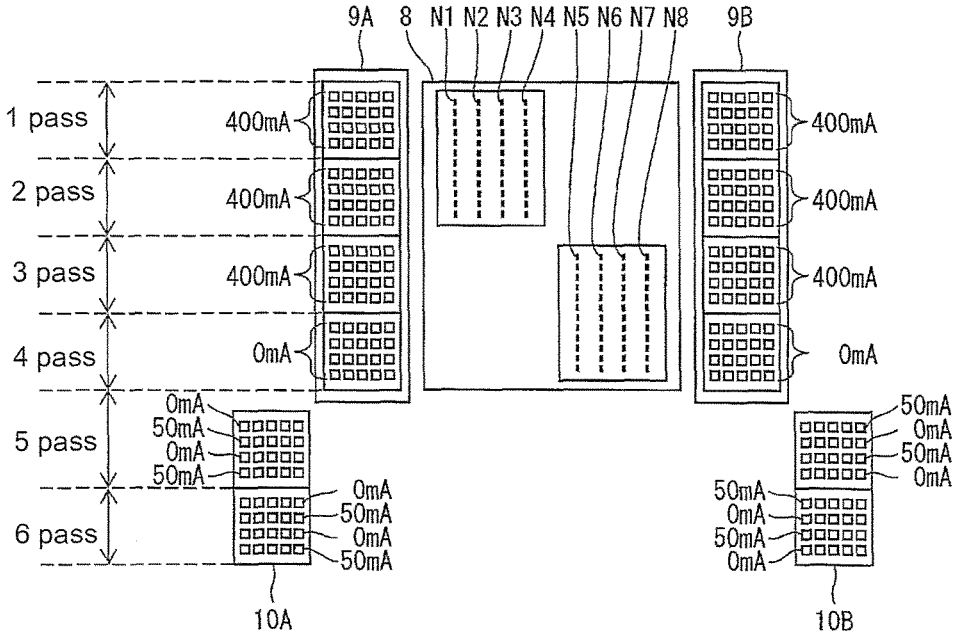
FIGS. 5A and 5B are views, illustrating exemplified values of electric current supplied to a plurality of irradiation elements according to the another embodiment of the present disclosure.
Figure 5B:
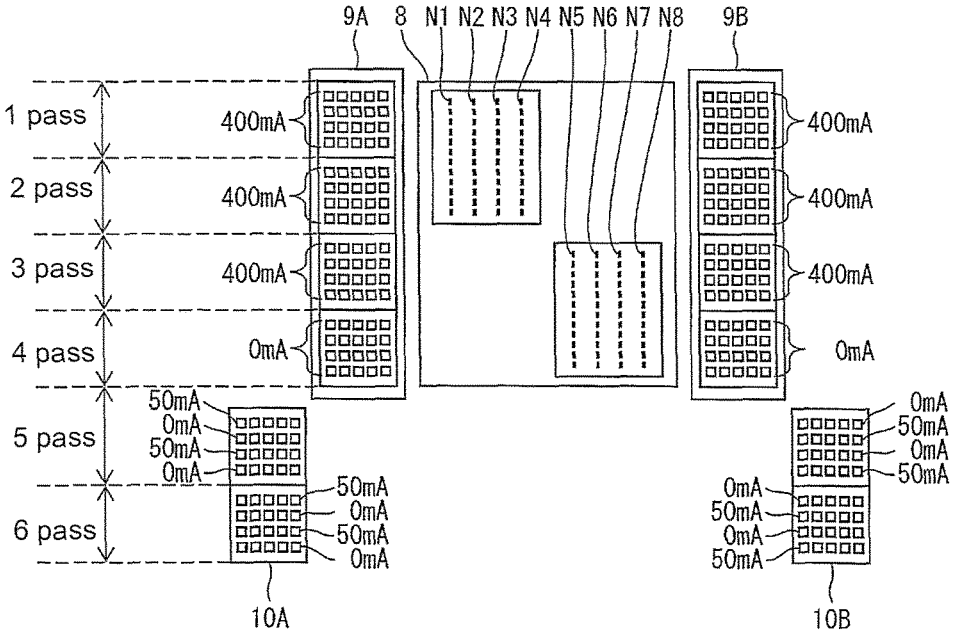

The second clear ink layer P3 on the medium M, if cured with intensive light, may be shrunk on curing, leading to possible creases on its surface. The second clear ink layer P3 is, therefore, preferably cured with weak light. The irradiation controller 20 weakens the light emitted from the irradiator 10A, 10B, which is hereinafter described referring to FIGS. 5A and 5B. FIGS. 5A and 5B are diagrams illustrating exemplified values of electric current to be supplied to the plurality of irradiation element.

As illustrated in FIG. 5A, the irradiation controller 20 supplies the electric current of 400 mA to the plurality of irradiation elements corresponding to the first to third passes in the right and left irradiators 9A and 9B, while supplying the electric current of 0 mA to the plurality of irradiation elements corresponding to the fourth pass in the right and left irradiators 9A and 9B. In contrast, the irradiation controller 20 supplies the electric current of 0 mA or 50 mA to the plurality of irradiation elements corresponding to the fifth and sixth passes in the irradiators 10A and 10B.

The irradiators 10A and 10B each have the plurality of irradiation elements arranged in the matrix shape. Specifically, the irradiators 10A and 10B each have a plurality of rows each including the plurality of irradiation elements arranged in the main scanning direction. The rows of these irradiation elements extend in the sub scanning direction. The irradiation controller 20 supplies different electric currents to the plurality of irradiation elements in different ones of the rows; 0 mA to the plurality of irradiation elements in one of the rows (i.e., the plurality of irradiation elements turned off), and 50 mA to the plurality of irradiation elements in the other one of the rows (i.e., the plurality of irradiation elements turned on).

In addition to weakening the light emitted from the irradiators 10A and 10B, the plurality of irradiation elements of these irradiators in one of the rows are turned on, while the plurality of irradiation elements in the other one of the rows are turned off. By combining these features, the irradiators 10A and 10B may be controlled to be lower in illuminance. The second clear ink layer P3 on the medium M thus cured with the weakened light may avoid the event of overcure. This may suppress shrinkage of this layer on curing, preventing the risk of creasing its surface.

The irradiation controller 20, in alternate ones of the rows, turns on the plurality of irradiation elements per row, and turns off or controls the plurality of irradiation elements to have a lower illuminance than the turned-on ones of the plurality of irradiation elements per row. The emitted light is intensified on the border between two consecutive rows of the plurality of irradiation elements emitting light. By thus having the plurality of irradiation elements in alternate ones of the rows be turned on and turned off per row, the emitted light may disperse, providing for a uniform illuminance.

To further ensure a uniform illuminance, the rows of light-emitting irradiation elements in the irradiator 10A respectively coincide in position with the rows of turned-off irradiation elements in the irradiator 10B, and the rows of turned-off irradiation elements emitting light in the irradiator 10A respectively coincide in position with the rows of light-emitting irradiation elements in the irradiator 10B. In other words, any one of the rows in which the plurality of irradiation elements are emitting light in one of the irradiators and any one of the rows in which the plurality of irradiation elements are turned off in the other one of the irradiators are disposed so as to face each other in the main scanning direction. Disposing the rows of light-emitting irradiation elements in the irradiator 10A so as to coincide in position with the rows of turned-off irradiation elements in the irradiator 10B may offer an advantageous effect independently from the printing operation in the previous passes (first to fourth passes). The inkjet printing apparatus thus characterized may cure the ink layers on the medium M with a uniform illuminance.

FIG. 5B shows the reversal of the plurality of irradiation elements of the irradiators 10A and 10B to be turned on and off. Specifically, the plurality of irradiation elements turned on in FIG. 5A are turned off, whereas the plurality of irradiation elements turned off in FIG. 5A are turned on. For example, ink droplets discharged through the respective nozzles of the head 8 may be irradiated with ultraviolet light in an equal amount by selecting the ON-OFF state in FIG. 5A in one of the passes and the ON-OFF state in FIG. 5B in the other one of the passes, alternately. This may disperse the emitted light, providing for a uniform illuminance.

The values of electric current supply illustrated in FIGS. 5A and 5B represent an exemplified case. The values of electric current supply in this disclosure are not limited to the illustrated examples. Among the plurality of irradiation elements in the irradiators 10A and 10B, the irradiation controller 20 may supply the first electric current to the plurality of irradiation elements in one of the rows, and supply the second electric current smaller than the first electric current to the plurality of irradiation elements in the other one of the rows. Specifically, the irradiation controller 20 may control the plurality of irradiation elements of the irradiators 10A and 10B, so that the plurality of irradiation elements in one of the rows have a first illuminance, and the plurality of irradiation elements in the other one of the rows have a second illuminance lower than the first illuminance. This may also suppress shrinkage of the layer on curing, preventing the risk of creasing its surface.

Among the irradiation elements in the irradiators 10A and 10B, the irradiation controller 20 may, in alternate ones of the rows, supply the first electric current to the plurality of irradiation elements per row, and supply the second electric current smaller than the first electric current to the plurality of irradiation elements per row. Specifically, among the irradiation elements in the irradiators 10A and 10B, the irradiation controller 20 may, in alternate ones of the rows, control the plurality of irradiation elements to have the first illuminance per row, and control the plurality of irradiation elements to have the second illuminance lower than the first illuminance per row. This structural feature may likewise disperse the emitted light, providing for a uniform illuminance.

Among the irradiation elements in the irradiators 10A and 10B, the irradiation controller 20 may turn on and turn off the plurality of irradiation elements per row in alternate ones of the rows. Among the irradiation elements in the irradiators 10A and 10B, the irradiation controller 20 may turn on and turn off random ones of the plurality of irradiation elements. This structural feature may likewise disperse the emitted light, providing for a uniform illuminance.

Among the irradiation elements in the irradiators 10A and 10B, the irradiation controller 20 may, in alternate ones of the rows, turn on the plurality of irradiation elements per row, and controls the plurality of irradiation elements to have a lower illuminance than the turned-on ones of the irradiation elements per row. Among the irradiation elements in the irradiators 10A and 10B, the irradiation controller 20 may turn on random ones of the irradiation elements and controls random ones of the irradiation elements to have a lower illuminance than the turned-on ones of the irradiation elements.

To control some of the irradiation elements to have a lower illuminance than the turned-on ones of the irradiation elements, the irradiation controller 20 may preferably supply, to the irradiation elements lower in illuminance, a voltage smaller than a voltage supplied to the turned-on ones of the plurality of irradiation elements.

Third Embodiment

Figure 6:
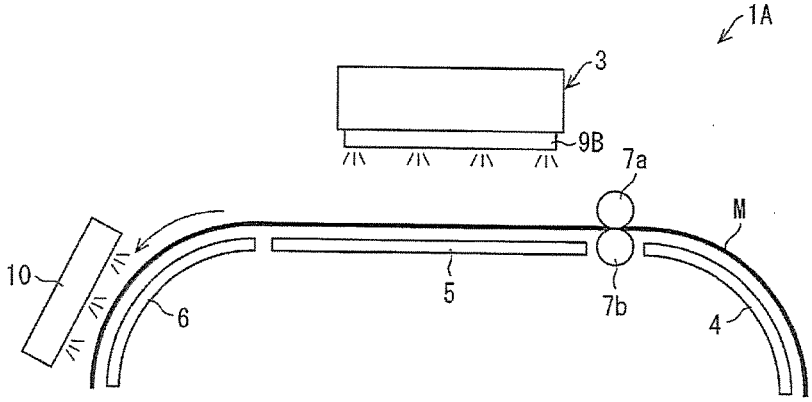
FIG. 6 is a schematic diagram of the internal structure of an inkjet printing apparatus according yet another embodiment of the present disclosure.

An inkjet printing apparatus according to a third embodiment of the present disclosure is hereinafter described in detail referring to FIG. 6. FIG. 6 is a schematic diagram of the internal structure of an inkjet printing apparatus 1A according this embodiment. Any structural parts functionally and operationally similar to those of the first embodiment are illustrated with the same reference signs, description of which is omitted.

[Irradiator 10]

The inkjet printing apparatus lA according to this embodiment further has an irradiator 10 (another irradiator). The irradiator 10 further emits ultraviolet light to the ink on the medium M already irradiated with ultraviolet light from the right and left irradiators 9A and 9B. The irradiator 10 is disposed at a position facing the after-printing platen 6. Specifically, the irradiator 10 is disposed at a position on the downstream side (downstream side of the right and left irradiators 9A and 9B in the transport direction) of the printing platen 5 in the transport direction of the medium M (sub scanning direction). The irradiator 10 irradiates the medium M with ultraviolet light after the image rendering on the medium M by the head 8 is completed.

[Inkjet Printing Method]

An inkjet printing method performed by the inkjet printing apparatus 1A according to this embodiment is hereinafter described. The printing operation in a plurality of passes is the same as that of the first embodiment, description of which is omitted.

After the printing operation in all of the passes is completed by the inkjet printing apparatus 1A according to this embodiment, a desired image is formed on the medium M. Then, the driving roller 7*a* (transport unit) and the driven roller 7*b* (transport unit) are rotated to transport the medium M from the printing platen 5 (from a position facing the right irradiator 9A and the left irradiator 9B). After the medium M is transported to the irradiator 10 disposed on the downstream side in the transport direction, the ink on the medium M is irradiated with ultraviolet light emitted from the irradiator 10. The ultraviolet light emitted from the irradiator 10 cures the glossy ink layer formed on the outermost surface of the medium M. This may flatten the surface of the glossy ink layer on the outermost surface of the medium M and thereby enhance a gloss finish effect on the glossy ink layer, while affording full cure of this layer.

To prevent the surface of the glossy ink layer from being creased, the irradiator 10 may preferably be controlled to emit a weakened light similarly to the irradiators 10A and 10B according to the second embodiment. The irradiator 10, therefore, may be configured and controlled in the same manner as the irradiators 10A and 10B.

Fourth Embodiment

Figure 7:
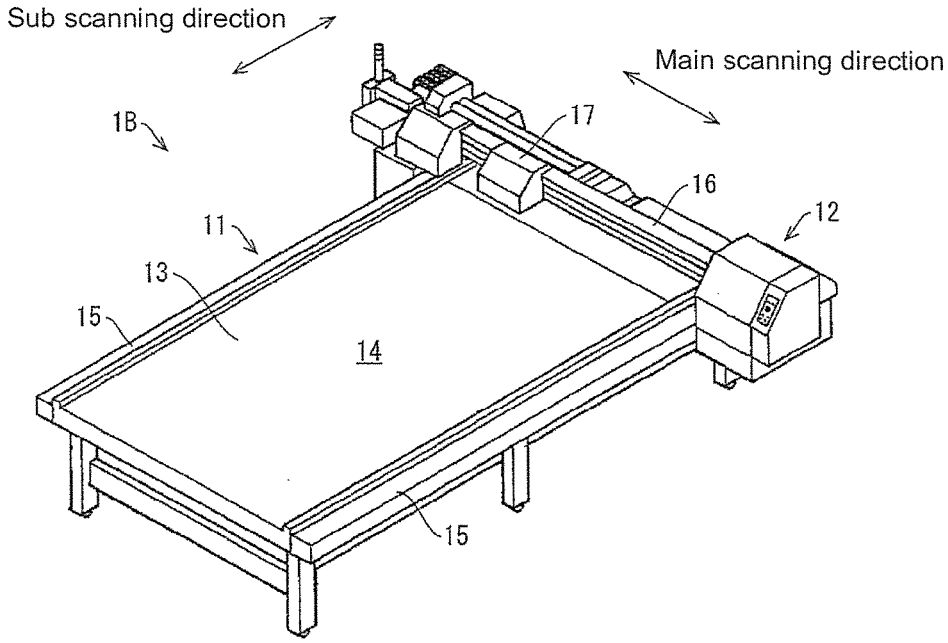
FIG. 7 is a schematic structural diagram of an inkjet printing apparatus according yet another embodiment of the present disclosure.

An inkjet printing apparatus according to a fourth embodiment of the present disclosure is hereinafter described in detail referring to FIG. 7. FIG. 7 is a schematic diagram of the structure of an inkjet printing apparatus 1B according this embodiment.

The inkjet printing apparatus disclosed herein may be a flatbed inkjet printing apparatus like the inkjet printing apparatus 1B illustrated in FIG. 7. The inkjet printing apparatus 1B has a first sub assembly 11 and a second sub assembly 12 mounted to the first sub assembly 11 in the upper direction thereof. The first sub assembly 11 has front-back moving mechanisms 15 on right and left sides of a flatbed 13 that securely holds thereon a medium (recording medium). These mechanisms are extending forward and backward. The second sub assembly 12 has a carriage 17. The carriage 17 is attached to the second sub assembly 12 so as to move laterally along a long guiding bar member 16 laterally extending. The flatbed 13 has a rectangular medium-setting table 14. A medium to be printed is set on this table. The medium is suctioned by a negative pressure through a large number of small holes formed on the upper surface of the medium-setting table 14 and thereby securely held on this table.

In the inkjet printing apparatus 1B thus structured, the guiding bar member 16 is movable forward and backward over the flatbed 13, and the carriage 17, facing the surface of the medium held on the flatbed 13, moves forward, backward, rightward, and leftward. While the carriage 17 is thus moving, inks are discharged from the head mounted in this carriage, and desired characters and/or pattern are printed with the inks on the upper surface of the medium.

Though not illustrated in the drawing, the inkjet printing apparatus 1B further has an irradiation controller as with the inkjet printing apparatus 1 according to the first embodiment. The carriage 17 is configured similarly to the carriage 3 according to the first embodiment. In the inkjet printing apparatus 1B, where the number of a plurality of passes is n (m is an integer smaller than n and greater than or equal to 1), the plurality of irradiation elements corresponding to passes before and inclusive of a (n−m)th pass are turned on, and the plurality of irradiation elements corresponding to the last (m)th pass are turned off.

In the passes before and inclusive of the (n−m)th pass, a color ink layer (colored layer) is formed from color inks (coloring inks), and a clear ink layer (coating layer) is partly formed from a clear ink (ink) as a coating layer for the color ink layer. Then, in the last (m)th pass, the rest of the clear ink layer is formed on the formed part of the clear ink layer. In the inkjet printing apparatus thus characterized, a matte ink layer formed in the (n−m)th pass may smooth any unevenness on the surface of the recording medium (or its underlayer). As a result, the ink discharged in the last (m)th pass and still wet may spread on the recording medium or the underlayer, forming a glossy ink layer having a flattened surface. Thus, a printed matter that excels in glossiness may be obtained.

In the inkjet printing apparatus 1B, the carriage 17 may be configured similarly to the carriage 3A according to the second embodiment, and/or the inkjet printing apparatus 1B may have an irradiator configured similarly to the irradiator 10 according to the third embodiment. This inkjet printing apparatus may flatten the surface of the glossy ink layer formed on the outermost surface of the medium and thereby enhance a gloss finish effect on the glossy ink layer, while affording full cure of the glossy ink layer.

The present disclosure is not necessarily limited to the embodiments described so far and may be carried out in many other forms. The technical scope of this disclosure encompasses any modifications within the technical scope disclosed herein that is defined by the appended claims and embodiments obtained by variously combining the technical means disclosed herein.

[Additional Remarks]

An inkjet printing apparatus 1 according to one aspect of the present disclosure is configured to perform a printing operation on a recording medium (medium M) set on a platen (printing platen 5) in a plurality of passes. The inkjet printing apparatus 1 includes: a head 8 that reciprocates in a main scanning direction while discharging an ink curable by being irradiated with light on the recording medium; an irradiator (right and left irradiators 9A and 9B) having a plurality of irradiation elements divided correspondingly to respective ones of the passes and configured to irradiate the ink on the recording medium with light; and an irradiation controller (irradiation controller 20) programmed to control the plurality of irradiation elements. The irradiation controller 20 turns on ones of the plurality of irradiation elements corresponding to the passes before and inclusive of a (n−m) th pass, and turns off or controls ones of the plurality of irradiation elements corresponding to a last (m)th pass to have a lower illuminance than the ones of the plurality of irradiation elements corresponding to the passes before and inclusive of the (n−m)th pass, where the number of the plurality of passes is n (m is an integer smaller than n and greater than or equal to 1), so that the ink discharged in the last (m)th pass on the recording medium remains uncured.

According to the above configuration, a matte ink layer formed in the (n−m)th pass may smooth any unevenness on the surface of the recording medium (or its underlayer). As a result, the ink discharged in the last (m)th pass and still wet may spread on the recording medium or the underlayer, forming a glossy ink layer having a flattened surface. Thus, a printed matter that excels in glossiness may be obtained.

The inkjet printing apparatus according to one aspect of the present disclosure may further include another irradiator (irradiators 10A and 10B) having another plurality of irradiation elements different from the plurality of irradiation elements. The irradiator irradiates the ink on the recording medium with light after the printing operation in the n number of passes on the recording medium is completed to cure the ink discharged on the recording medium in the last (m)th pass and still left uncured with light for full cure of the ink. The another irradiator is disposed on a downstream side of the irradiator in a sub scanning direction orthogonal to the main scanning direction. The another irradiator, after the printing operation in the n number of passes on the recording medium is completed, irradiates the ink discharged on the recording medium in the last (m)th pass and still uncured with light in a plurality of passes to cure the ink.

According to the above configuration, the inkjet printing apparatus may flatten the surface of the glossy ink layer formed on the outermost surface of the recording medium and thereby enhance a gloss finish effect on the glossy ink layer, while affording full cure of the glossy ink layer. By irradiating the ink with light using the irradiator in a plurality of passes, full cure of the ink left uncured on the recording medium may be finely controlled.

In the inkjet printing apparatus according to one aspect of the present disclosure, the another irradiator has a plurality of rows each including the another plurality of irradiation elements arranged in the main scanning direction, the plurality of rows extend in the sub scanning direction orthogonal to the main scanning direction, the irradiation controller turns on ones of the another plurality of irradiation elements in one of the plurality of rows, and the irradiation controller turns off or controls ones of the another plurality of irradiation elements in the other one of the rows to have a lower illuminance than the turned-on ones of the another plurality of irradiation elements.

According to the above configuration, in the inkjet printing apparatus, the plurality of irradiation elements in one of the rows are turned on, while the plurality of irradiation elements in the other one of the rows are turned off or controlled to have a lower illuminance. This may lower the illuminance of the irradiator. Therefore, the glossy ink layer formed on the outermost surface of the recording medium is cured by weak light. This may prevent overcure of the ink. This may suppress shrinkage of this layer on curing, preventing the risk of creasing its surface.

In the inkjet printing apparatus according to one aspect of the present disclosure, the irradiation controller, in alternate ones of the rows, turns on the another plurality of irradiation elements per row, and turns off or controls the another plurality of irradiation elements to have a lower illuminance than the turned-on ones of the another plurality of irradiation elements per row.

According to the above configuration, the emitted light is intensified on the border between two consecutive rows of irradiation elements emitting light. By thus having the plurality of irradiation elements in alternate ones of the rows be turned on per row, and turned off or controlled have a lower illuminance per row, the emitted light may disperse, providing for a uniform illuminance.

In the inkjet printing apparatus according to one aspect of the present disclosure, the irradiator has a plurality of rows each including the plurality of irradiation elements arranged in the main scanning direction, the plurality of rows extend in the sub scanning direction orthogonal to the main scanning direction, the irradiation controller turns on ones of the plurality of irradiation elements corresponding to the last (m)th pass in one of the plurality of rows, and the irradiation controller turns off or controls ones of the plurality of irradiation elements corresponding to the last (m)th pass in the other one of the rows to have a lower illuminance than the turned-on ones of the plurality of irradiation elements.

According to the above configuration, the irradiation controller of this inkjet printing apparatus, among the irradiation elements corresponding to the last (m)th pass in the irradiator, turns on the plurality of irradiation elements in one of the rows, and turn off the plurality of irradiation elements in the other one of the rows. This may suppress the illuminance of a portion of the irradiator corresponding to the last (m)th pass.

In the inkjet printing apparatus according to one aspect of the present disclosure, the irradiation controller, in alternate ones of the rows, turns on ones of the plurality of irradiation elements corresponding to the last (m)th pass per row, and turns off or controls ones of the plurality of irradiation elements corresponding to the last (m)th pass to have a lower illuminance than the turned-on ones of the plurality of irradiation elements per row.

According to the above configuration, the emitted light is intensified on the border between two consecutive rows of a plurality of irradiation elements emitting light. By thus having the plurality of irradiation elements in alternate ones of the rows be turned on per row, and turned off or controlled have a lower illuminance per row, the emitted light may disperse, providing for a uniform illuminance.

In the inkjet printing apparatus according to one aspect of the present disclosure, the another irradiator is two irradiators arranged in the main scanning direction, the another irradiators are disposed at right and left positions in a view from the head in the sub scanning direction, and any one of the rows in one of the another irradiators in which the another plurality of irradiation elements are turned on and any one of the rows in the other one of the another irradiators in which the plurality of irradiation elements are turned off or controlled to have a lower illuminance than the turned-on ones of the plurality of irradiation elements are disposed so as to face each other in the main scanning direction.

According to the above configuration, the inkjet printing apparatus may cure the glossy ink layer formed on the recording medium with a uniform illuminance.

In the inkjet printing apparatus according to one aspect of the present disclosure, the irradiation controller selectively turns on and turns off the another plurality of irradiation elements or adjusts the illuminance of the another plurality of irradiation elements. The irradiation controller may selectively turn on and turn off each one of the another plurality of irradiation elements or adjust the illuminance of each one of the another plurality of irradiation elements. The irradiation controller may selectively turn on and turn off the another plurality of irradiation elements for each one of the rows or adjust the illuminance of the another plurality of irradiation elements for each one of the rows.

According to the above configuration, the irradiation of light from the another irradiator may be controlled by selectively turning on and turning off the another plurality of irradiation elements or by adjusting their degrees of illuminance. By selectively turning on and off each one of the another plurality of irradiation elements or by adjusting the illuminance of each one of the another plurality of irradiation elements, the proportion of the irradiation elements currently turned on may be changed or the illuminance of each irradiation element may be changed. The irradiation of light may accordingly be controlled in a finely-tuned manner. The another plurality of irradiation elements may be selectively turned on and turned off for each one of the rows, or their degrees of illuminance may be adjusted for each one of the rows. This enables the light irradiation control per row to facilitate the light irradiation control, making it unnecessary to equip the irradiation controller with a complicated control circuit.

In the inkjet printing apparatus according to one aspect of the present disclosure, the irradiation controller outputs binary digital signals to the another plurality of irradiation elements to selectively turn on and off the another plurality of irradiation elements, or the irradiation controller regulates values of electric current to be supplied to the another plurality of irradiation elements to adjust their degrees of illuminance.

According to the above configuration, in the inkjet printing apparatus, the irradiation elements are controlled based on the binary digital signals, i.e., the irradiation elements are simply controlled to be turned on and off. This may facilitate the control, making it unnecessary to equip the irradiation controller with a complicated control circuit. The illuminance may be controlled in a finely-tuned manner by adjusting the values of electric current to be supplied to the irradiation elements. This may allow the irradiation elements to have a desired illuminance or an approximate illuminance.

The inkjet printing apparatus according to one aspect of the present disclosure further includes: a transport unit (driving roller 7*a* and driven roller 7*b*) that transports the recording medium from a position facing the irradiator after the printing operation in the n number of passes on the recording medium is completed; and another irradiator (irradiator 10) disposed on a downstream side of the irradiator in a direction in which the recording medium is transported by the transport unit. The another irradiator irradiates the ink on the recording medium with light.

According to the above configuration, the inkjet printing apparatus may flatten the surface of the glossy ink layer formed on the outermost surface of the recording medium and thereby enhance a gloss finish effect on the glossy ink layer, while affording full cure of the glossy ink layer.

In the inkjet printing apparatus according to one aspect of the present disclosure, a colored layer is formed from a color ink and a coating layer for the colored layer is partly formed from a coating ink in the passes before and inclusive of the (n−m)th pass, and a remaining part of the coating layer is formed in the last (m)th pass on a formed part of the coating layer.

According to the above configuration, by forming the matte and glossy ink layers as a coating layer on the colored layer, the recording medium may be coated with an overcoat that excels in glossiness.

One aspect of the present disclosure provides an inkjet printing method of performing a printing operation on a recording medium (medium M) set on a platen (printing platen 5) in a plurality of passes. The inkjet printing method includes: an ink discharge step of discharging an ink curable by being irradiated with light on the recording medium; and an irradiating step of irradiating the ink on the recording medium with light emitted from a plurality of irradiation elements corresponding to respective ones of the passes. In the irradiating step, ones of the plurality of irradiation elements corresponding to the passes before and inclusive of a (n−m)th pass are turned on, and ones of the plurality of irradiation elements corresponding to a last (m)th pass are turned off or controlled to have a lower illuminance than the ones of the plurality of irradiation elements corresponding to the passes before and inclusive of the (n−m)th pass, where the number of the plurality of passes is n (m is an integer smaller than n and greater than or equal to 1), so that the ink discharged in the last (m)th pass on the recording medium remains uncured.

According to the method, this inkjet printing method may exert the same effects as exerted by the inkjet printing apparatus 1 according to one aspect of the present disclosure.

INDUSTRIAL APPLICABILITY

The present disclosure is applicable to inkjet printing.

The invention claimed is:

1. An inkjet printing apparatus configured to perform a printing operation on a recording medium set on a platen in a plurality of passes, the inkjet printing apparatus comprising:

a head that reciprocates in a main scanning direction while discharging an ink curable by being irradiated with light on the recording medium;

an irradiator having a plurality of irradiation elements divided correspondingly to respective ones of the passes and configured to irradiate the ink on the recording medium with light; and an irradiation controller programmed to control the plurality of irradiation elements, wherein the plurality of irradiation elements are controlled by the irradiation controller so as to turn on ones of the plurality of irradiation elements corresponding to the passes before and inclusive of a (n−m)th pass, and so as to turn off or control ones of the plurality of irradiation elements corresponding to a last (m)th pass to have a lower illuminance than the ones of the plurality of irradiation elements corresponding to the passes before and inclusive of the (n−m)th pass, where the number of the plurality of passes is n (m is an integer smaller than n and greater than or equal to 1), so that the ink discharged in the last (m)th pass on the recording medium remains uncured.

2. The inkjet printing apparatus as set forth in claim 1, further comprising another irradiator having another plurality of irradiation elements different from the plurality of irradiation elements, wherein the irradiation elements of the another irradiator irradiate the ink on the recording medium with light after the printing operation in the n number of passes on the recording medium is completed to cure the ink discharged on the recording medium in the last (m)th pass and still uncured, and the another irradiator is disposed on a downstream side of the irradiator in a sub scanning direction orthogonal to the main scanning direction.

3. The inkjet printing apparatus as set forth in claim 2, wherein the another irradiator irradiates the ink on the recording medium with light in a plurality of passes after the printing operation in the n number of passes on the recording medium is completed to cure the ink discharged on the recording medium in the last (m)th pass and still uncured.

4. The inkjet printing apparatus as set forth in claim 3, wherein the another irradiator has a plurality of rows each including the another plurality of irradiation elements arranged in the main scanning direction, the plurality of rows extending in the sub scanning direction orthogonal to the main scanning direction, the irradiation controller turns on ones of the another plurality of irradiation elements in one of the plurality of rows, and the irradiation controller turns off or controls ones of the another plurality of irradiation elements in the other one of the rows to have a lower illuminance than the turned-on ones of the plurality of irradiation elements.

5. The inkjet printing apparatus as set forth in claim 3, wherein the irradiator has a plurality of rows each including the plurality of irradiation elements arranged in the main scanning direction, the plurality of rows extending in the sub scanning direction orthogonal to the main scanning direction, the irradiation controller turns on ones of the plurality of irradiation elements corresponding to the last (m)th pass in one of the plurality of rows, and the irradiation controller turns off or controls ones of the plurality of irradiation elements corresponding to the last (m)th pass in the other one of the rows to have a lower illuminance than the turned-on ones of the plurality of irradiation elements.

6. The inkjet printing apparatus as set forth in claim 3, wherein the irradiation controller selectively turns on and off the another plurality of irradiation elements or adjusts the illuminance of the another plurality of irradiation elements.

7. The inkjet printing apparatus as set forth in claim 2, wherein the another irradiator has a plurality of rows each including the another plurality of irradiation elements arranged in the main scanning direction, the plurality of rows extending in the sub scanning direction orthogonal to the main scanning direction, the irradiation controller turns on ones of the another plurality of irradiation elements in one of the plurality of rows, and the irradiation controller turns off or controls ones of the another plurality of irradiation elements in the other one of the rows to have a lower illuminance than the turned-on ones of the plurality of irradiation elements.

8. The inkjet printing apparatus as set forth in claim 7, wherein the irradiation controller, in alternate ones of the rows, turns on the another plurality of irradiation elements per row, and turns off or controls the another plurality of irradiation elements to have a lower illuminance than the turned-on ones of the plurality of irradiation elements per row.

9. The inkjet printing apparatus as set forth in claim 2, wherein the irradiator has a plurality of rows each including the plurality of irradiation elements arranged in the main scanning direction, the plurality of rows extending in the sub scanning direction orthogonal to the main scanning direction, the irradiation controller turns on ones of the plurality of irradiation elements corresponding to the last (m)th pass in one of the plurality of rows, and the irradiation controller turns off or controls ones of the plurality of irradiation elements corresponding to the last (m)th pass in the other one of the rows to have a lower illuminance than the turned-on ones of the plurality of irradiation elements.

10. The inkjet printing apparatus as set forth in claim 9, wherein the irradiation controller, in alternate ones of the rows, turns on ones of the plurality of irradiation elements corresponding to the last (m)th pass per row, and turns off or controls ones of the plurality of irradiation elements corresponding to the last (m)th pass to have a lower illuminance than the turned-on ones of the plurality of irradiation elements per row.

11. The inkjet printing apparatus as set forth in claim 10, wherein the another irradiator is two irradiators arranged in the main scanning direction, the another irradiators are disposed at right and left positions in a view from the head in the sub scanning direction, and any one of the rows in one of the another irradiators in which the another plurality of irradiation elements are turned on and any one of the rows in the other one of the another irradiators in which the plurality of irradiation elements are turned off or controlled to have a lower illuminance than the turned-on ones of the plurality of irradiation elements are disposed so as to face each other n the main scanning direction.

12. The inkjet printing apparatus as set forth in claim 2, wherein the irradiation controller selectively turns on and off the another plurality of irradiation elements or adjusts the illuminance of the another plurality of irradiation elements.

13. The inkjet printing apparatus as set forth in claim 12, wherein the irradiation controller selectively turns on and turn off each one of the another plurality of irradiation elements or adjusts the illuminance of each one of the another plurality of irradiation elements.

14. The inkjet printing apparatus as set forth in claim 12, wherein the another irradiator has a plurality of rows each including the another plurality of irradiation elements arranged in the main scanning direction, the plurality of rows extending in the sub scanning direction orthogonal to the main scanning direction, and the irradiation controller selectively turns on and turns off the another plurality of irradiation elements for each one of the rows or adjusts the illuminance of the another plurality of irradiation elements for each one of the rows.

15. The inkjet printing apparatus as set forth in claim 12, wherein the irradiation controller outputs binary digital signals to the another plurality of irradiation elements to selectively turn on and off the irradiation elements.

16. The inkjet printing apparatus as set forth in claim 12, wherein the irradiation controller regulates values of electric current to be supplied to the another plurality of irradiation elements to adjust the illuminance of the another plurality of irradiation elements.

17. The inkjet printing apparatus as set forth in claim 1, further comprising:

a transport unit that transports the recording medium from a position facing the irradiator after the printing operation in the n number of passes on the recording medium is completed; and another irradiator disposed on a downstream side of the irradiator in a direction in which the recording medium is transported by the transport unit, the another irradiator irradiating the ink on the recording medium with light.

18. The inkjet printing apparatus as set forth in claim 1, wherein a colored layer is formed from a color ink and a coating layer for the colored layer is partly formed from a coating ink in the passes before and inclusive of the (n−m)th pass, and a remaining part of the coating layer is formed in the last (m)th pass on a formed part of the coating layer.

19. An inkjet printing method of performing a printing operation on a recording medium set on a platen in a plurality of passes, the method comprising:

an ink discharge step of discharging an ink curable by being irradiated with light on the recording medium; and an irradiating step of irradiating the ink on the recording medium with light emitted from a plurality of irradiation elements corresponding to respective ones of the passes, wherein the plurality of irradiation elements are controlled in the irradiating step so as to turn on ones of the plurality of irradiation elements corresponding to the passes before and inclusive of a (n−m)th pass, and so as to turn off or control ones of the plurality of irradiation elements corresponding to a last (m)th pass to have a lower illuminance than the ones of the plurality of irradiation elements corresponding to the passes before and inclusive of the (n−m)th pass, where the number of the plurality of passes is n (m is an integer smaller than n and greater than or equal to 1), so that the ink discharged in the last (m)th pass on the recording medium remains uncured.

* * * * *